US007088839B2

(12) United States Patent
Geschiere et al.

(10) Patent No.: US 7,088,839 B2
(45) Date of Patent: Aug. 8, 2006

(54) ACOUSTIC RECEIVER HAVING IMPROVED MECHANICAL SUSPENSION

(75) Inventors: Onno Geschiere, Amstredam (NL); Jan Hijman, De Bilt (NL); Jeroen P. J. Augustijn, Leiden (NL); Arno W. Koenderink, Oostzaan (NL); Justus Elisa Auf dem Brinke, Purmerend (NL)

(73) Assignee: Sonion Nederland B.V., Amsterdam (NL)

( * ) Notice: Subject to any disclaimer, the term of this patent is extended or adjusted under 35 U.S.C. 154(b) by 346 days.

(21) Appl. No.: 10/115,528

(22) Filed: Apr. 3, 2002

(65) Prior Publication Data

US 2002/0146141 A1 Oct. 10, 2002

Related U.S. Application Data

(60) Provisional application No. 60/281,492, filed on Apr. 4, 2001.

(51) Int. Cl.
*H04R 25/00* (2006.01)

(52) U.S. Cl. ..... 381/368; 381/361; 381/355; 381/392; 381/324; 381/353

(58) Field of Classification Search ..... 381/361, 381/368, 355, 386, 392, 324, 353, 354; 181/166, 181/158, 171, 172
See application file for complete search history.

(56) References Cited

U.S. PATENT DOCUMENTS

| | | | | |
|---|---|---|---|---|
| 3,048,668 | A | 8/1962 | Weiss | 179/179 |
| 3,257,516 | A | 6/1966 | Knowles | 179/180 |
| 4,081,782 | A | 3/1978 | Hildreth et al. | 338/200 |
| 4,440,982 | A | 4/1984 | Kaanders et al. | 179/107 R |
| 4,520,236 | A | 5/1985 | Gauthier | 179/107 |
| 4,620,605 | A | 11/1986 | Gore et al. | 181/135 |
| 4,634,815 | A | 1/1987 | Marquis | 387/68.4 |
| 4,729,451 | A | 3/1988 | Brander et al. | 181/130 |
| 4,854,415 | A * | 8/1989 | Goschke | 181/130 |
| 5,220,612 | A | 6/1993 | Tibbetts et al. | 381/68 |
| 5,809,151 | A | 9/1998 | Husung | 381/69 |
| 5,887,070 | A * | 3/1999 | Iseberg et al. | 381/380 |
| 6,078,677 | A | 6/2000 | Dolleman et al. | 381/418 |
| 6,169,810 | B1 | 1/2001 | van Halteren et al. | 381/174 |
| 6,456,720 | B1 | 9/2002 | Brimhall et al. | 381/324 |
| RE38,351 | E | 12/2003 | Iseberg et al. | 381/380 |
| 6,751,326 | B1 | 6/2004 | Nepomuceno | 381/322 |
| 2001/0036289 | A1 | 11/2001 | Nepomuceno | 381/324 |
| 2002/0061113 | A1 | 5/2002 | van Halteren et al. | 381/322 |
| 2002/0146141 | A1 | 10/2002 | Geschiere et al. | 381/368 |

FOREIGN PATENT DOCUMENTS

DE 23 46 531 A1 4/1975

(Continued)

*Primary Examiner*—Curt Kuntz
*Assistant Examiner*—Tuan Duc Nguyen
(74) *Attorney, Agent, or Firm*—Jenkens & Gilchrist

(57) ABSTRACT

The present invention is a receiver that includes electronics for converting an input audio signal to an output acoustic signal. The receiver has a housing for containing at least a portion of the electronics. The housing includes a port for broadcasting the output acoustic signal. A suspension system is coupled to the housing for dampening vibrations of the housing. In one preferred embodiment, the suspension system includes three resilient contact structures for contacting a surrounding structure in which the receiver is placed. The contact structures are positioned at specific locations to provide variable dampening levels. In another embodiment, the dampening is provided by a low-viscosity, gel-like material positioned between the housing and the surrounding structure.

15 Claims, 9 Drawing Sheets

FOREIGN PATENT DOCUMENTS

| | | | |
|---|---|---|---|
| DE | 199 54 880 | C1 | 1/2001 |
| EP | 0 337 195 | A2 | 3/1989 |
| EP | 0 416 155 | A1 | 9/1989 |
| EP | 0 354 698 | A2 | 2/1990 |
| EP | 0 354 698 | A3 | 2/1990 |
| EP | 0 349 835 | A1 | 10/1990 |
| EP | 0 589 308 | A1 | 3/1994 |
| GB | 2 305 067 | A | 3/1997 |
| WO | WO 99/43194 | A2 | 9/1999 |
| WO | WO 00/79832 | A2 | 12/2000 |
| WO | WO 01/43498 | A1 | 6/2001 |
| WO | WO 01/69974 | A2 | 9/2001 |

* cited by examiner

ACOUSTIC RECEIVER HAVING IMPROVED MECHANICAL SUSPENSION

RELATED APPLICATION

This application claims the benefit of priority of U.S. Provisional Patent Application No. 60/281,492, filed Apr. 4, 2001.

FIELD OF THE INVENTION

The invention relates to miniature receivers used in listening devices, such as hearing aids. In particular, the present invention relates to a mechanical suspension system that dampens the vibrations from the acoustic signals being broadcast by the receiver.

BACKGROUND OF THE INVENTION

A conventional hearing aid or listening device includes a microphone that receives acoustic sound waves and converts the acoustic sound waves to an audio signal. That audio signal is then processed (e.g., amplified) and sent to the receiver of the hearing aid or listening device. The receiver then converts the processed signal to an acoustic signal that is broadcast toward the eardrum.

The broadcasting of the acoustic signal causes the receiver to vibrate. The vibrations can affect the overall performance of the listening device. For example, the vibrations in the receiver can be transmitted back to the microphone, causing unwanted feedback. Consequently, it is desirable to reduce the amount of vibrations that occur in the receiver of the hearing aid or listening device.

In one known prior art system, a pair of elastomeric sleeves are placed on the ends of the receiver. Each of the sleeves includes four distinct projections that engage the surrounding structure within which the receiver is placed. The eight projections are located adjacent to the eight corners of the receiver. The amount of dampening that is provided by the projections, however, is dependent on the material of the projections and also the relative amount of engagement force between each of the eight projections and the adjacent portions of the surrounding structure. Additionally, because the vibration pattern on the housing of the receiver varies depending on the distance from the acoustic output port, having eight similar projections at each corner may provide too much dampening at one position and not enough dampening at another position.

Other prior art techniques use foam tape to attach the receiver to the inside of the hearing aid structure or a rubber boot-like structure that is similar to the aforementioned prior art device. Again, it is very difficult to control the amount of dampening in these prior art suspension systems because the amount of dampening is dependent on the material properties and the exact location where contact is being made with the surrounding structure is not precisely known.

SUMMARY OF THE INVENTION

The present invention is a receiver that includes electronics for converting an input audio signal to an output acoustic signal. The receiver has a housing for containing at least a portion of the electronics. The housing includes a port for broadcasting the output acoustic signal. A suspension system is coupled to the is housing for dampening vibrations of the housing.

In one preferred embodiment, the suspension system includes three resilient contact structures for contacting a surrounding structure in which the receiver is placed. The contact structures are positioned at specific locations to provide optimum dampening. Thus, the amount of dampening varies as a function of the location on the housing of the receiver.

In another preferred embodiment, the dampening is provided by a low-viscosity, gel-like material positioned between the housing and the surrounding structure.

In yet a further preferred embodiment, the mechanical suspension of the receiver is provided by a thin layer of material located around the receiver housing. The thin layer of material is attached to the housing at its periphery. The thin layer of material is also attached to an external structure, preferably an outer casing, that surrounds the housing.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

FIGS. 12A–2B illustrate another embodiment of the present invention where the mechanical suspension is provided by a portion of the diaphragm that extends beyond the periphery of the receiver housing.

Figure 1A:
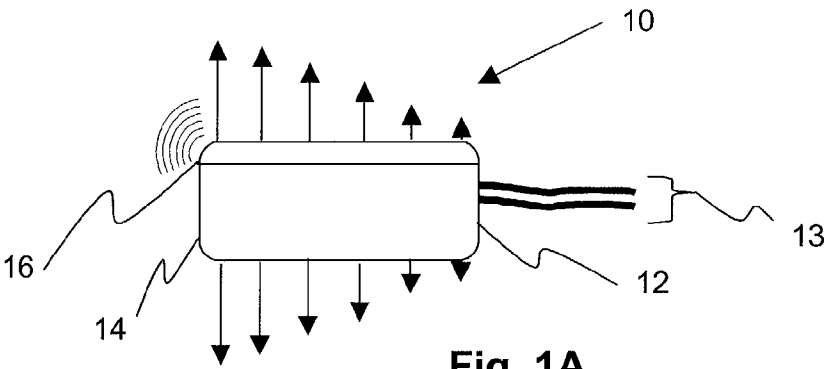
FIGS. 1A–1B schematically illustrate the amplitude patterns on a receiver.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 1B:
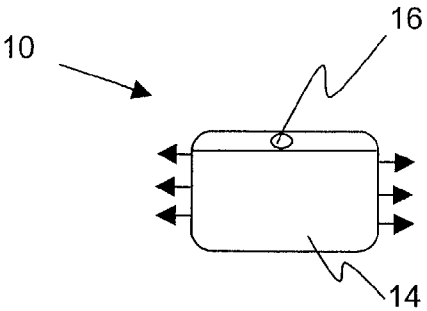

FIGS. 1A and 1B illustrate the vibration patterns in a typical receiver 10. As shown, the receiver 10 includes a back side 12 that usually carries the lead wires 13 connecting the receiver 10 to the other components in the acoustic system. The receiver 10 includes a front side 14 having an output port 16 for broadcasting an acoustic signal that corresponds to the audio signal that is transmitted into the receiver by lead wires 13. The output port 16 may be a simple opening in the front side 14 or may include a snout extending from the front side 14.

The amplitude of the vibrations (shown as arrows) primarily depends on the distance from the acoustic source, which is the output port 16. Thus, the largest amplitude occurs at the front side 14 of the receiver 10, and the smallest amplitude occurs at the back side 12 of the receiver 10. While the ratio of the amplitudes at the front side 14 and the back side 12 depend on the geometry of the receiver 10, the amplitude at the front side 14 is usually about four times larger than that of the back side 12, with amplitudes being in the order of microns. The largest amplitude usually occurs when the output port 16 is broadcasting acoustic signals in the range of 2–4 Khz. As shown best in FIG. 1B, the receiver 10 also moves from side to side, although the amplitude at which it does so is relatively small. Typically, the amplitude of the side-to-side movement is an order of magnitude (i.e., about 10 times) less than the amplitude of the vertical movement.

Because the larger amplitude occurs at the front side 14 of the receiver 10, the front side 14 requires more dampening than the back side 12 of the receiver 10. As will be described in detail below, the mechanical suspension system of the present invention provides a variable dampening along the surfaces of the receiver 10. The present invention also helps minimize the damaging effects of shock that may cause the internal moving components of the receiver 10 (e.g., armature, drive rod, etc.) to deflect beyond their elastic limits.

Figure 2:
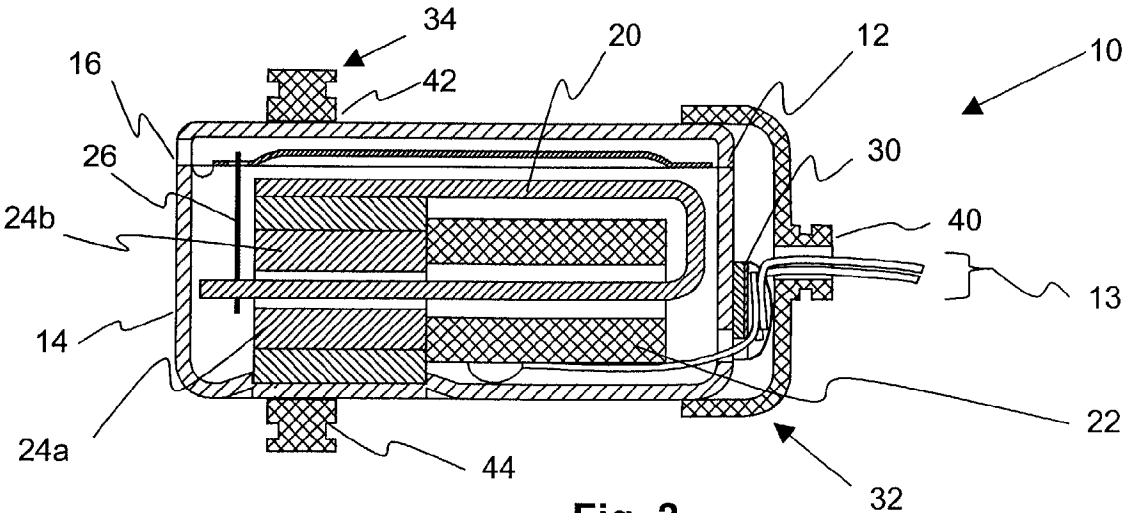
FIG. 2 illustrates a cross-section of the receiver incorporating the inventive mechanical suspension system.
Figure 3A:
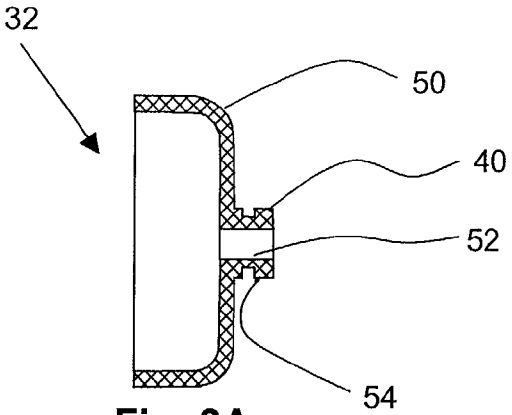
FIGS. 3A–3D illustrate the back suspension in the mechanical suspension system.
Figure 3B:
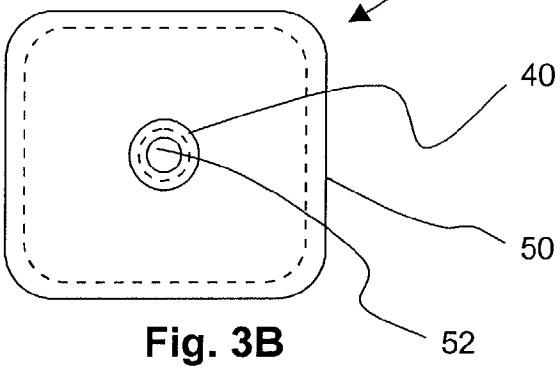
Figure 3C:
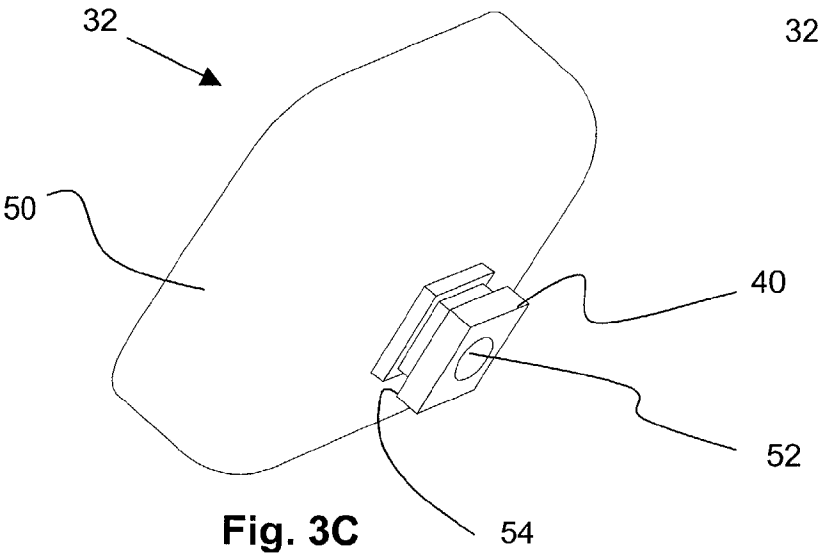
Figure 3D:
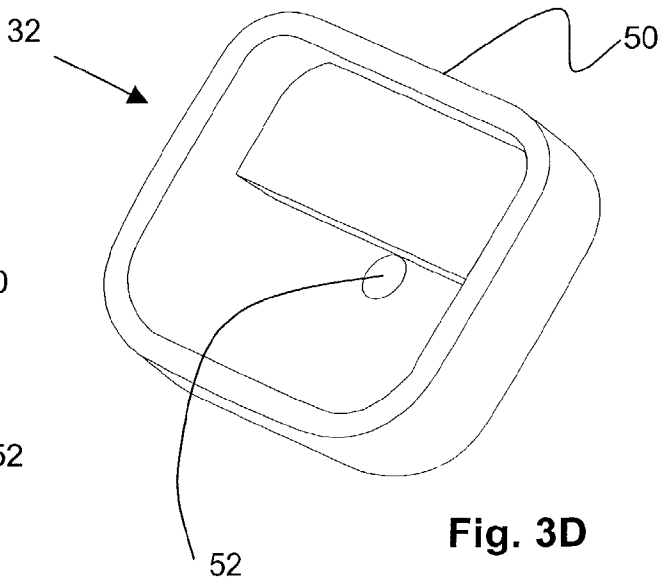

FIG. 2 illustrates the receiver 10 incorporating the inventive mechanical suspension system. The receiver 10 includes a U-shaped armature 20 that extends between a coil 22 and a pair of magnets 24*a*, 24*b*. The free end of the armature 20 is coupled to a drive rod 26 which, in turn, is coupled to a diaphragm 28. The audio signals are transmitted into the receiver 10 through the lead wires 13, which are attached to a contact assembly 30 at the back side 12 of the receiver 10. The contact assembly 30 may be in the form of a printed circuit board which has surface mount contact pads. The audio signals received at the contact assembly 30 are transmitted to the coil 22, which causes a certain electromagnetic field that acts on the armature 20. The electromagnetic field results in a known movement of the armature 20, which leads to a known movement in the diaphragm 28. The displacement of the air above the diaphragm 28 causes the broadcasting of an output acoustical signal from the output port 16 that corresponds to the input audio signal. The receiver 10 is a typical one used in the listening device industry. The invention, of course, is useful with all types of receivers, such as those with E-shaped armatures.

The mechanical suspension system includes a back suspension 32 and a front suspension 34. The back suspension 32 fits around the back side 12 of the receiver 10, while the front suspension 34 surrounds a portion of the receiver 10 adjacent to the front side 14. The back suspension 32 includes a back contact structure 40 that is used for mounting the receiver 10 to a surrounding structure. The front suspension 34 includes two front contact structures 42, 44 that are used for mounting the receiver 10 to a surrounding structure. The back suspension 32 is shown in more detail in FIG. 3 and the front suspension 34 is shown in more detail in FIG. 4.

Referring to FIGS. 3A–3D, the back suspension 32 includes a cradle section 50 that surrounds the back side 12 of the receiver 10. The back contact structure 40 is attached to the cradle section 50 at approximately its center point. The back contact structure 40 has an opening 52 through which the lead wires 13 extend. The back contact structure 40 also includes an attachment region 54 into which the surrounding structure will be attached. As shown, the attachment region 54 is a region of reduced cross-section (i.e., a groove) in the elongated back contact structure 40. While the attachment region 54 is shown as having a rectangular cross-section, it may also have a circular cross-section. Further, the shape of the back contact structure 40 may also differ from the rectangular shape that is shown in FIGS. 3A–3D. The back suspension 32 is made of an elastomeric material that provides the dampening of the vibrations in the receiver 10 that occur at and adjacent to its back side 12. One type of elastomer that is useful is a silicone rubber. Because the back side 12 of the receiver 10 is not subjected to large vibrational amplitudes, the amount of dampening that is provided by the back suspension 32 does not need to be as much as that which is provided by the front suspension 34. In essence, the back suspension 32 provides a hinge at the back contact structure 40 around which the remaining portion of the receiver 10 will pivot when subjected to vibrations.

Figure 4B:
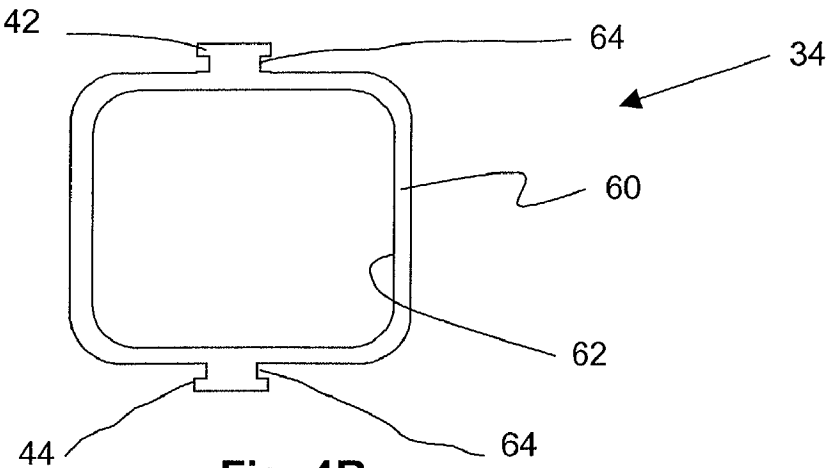
FIGS. 4A–4B illustrate the front suspension in the mechanical suspension system.
Figure 4A:
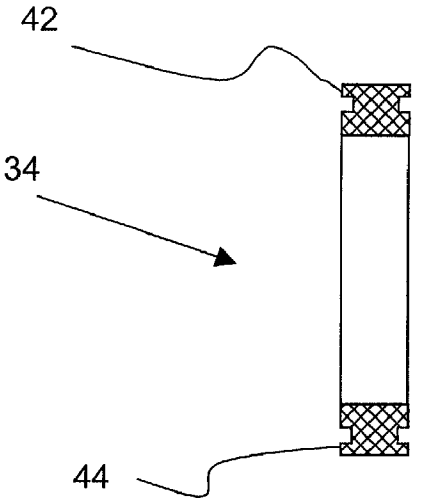

Referring now to FIGS. 4A–4B, the front suspension 34 includes a cradle section 60 having an interior surface 62 that engages the exterior of the receiver 10. Thus, the front suspension 34 has a rectangular annular shape. Each of the front contact structures 42, 44 includes an attachment region 64 that allows the contact structures 42, 44 to mount within the surrounding structure of the receiver 10. While the attachment region 64 has a rectangular cross-section, it may also have a circular cross-section. And, the shape of the front contact structures 42, 44 may differ to accommodate different mounting arrangements with the surrounding structure. The front suspension 34 is made of an elastomeric material that dampens the vibrations in the receiver 10 that occur at and adjacent to its front side 14.

Figure 5:
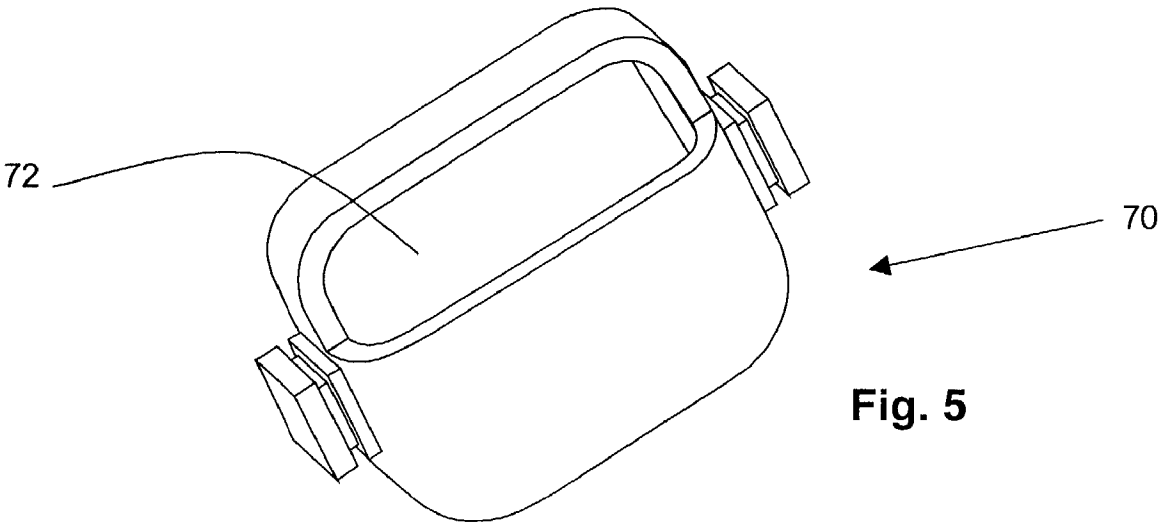
FIG. 5 illustrates an alternative embodiment to the front suspension in the mechanical suspension system.

Further, the front suspension may have a portion that extends around and engages the front side 14 of the receiver 10, as is shown in the alternative front suspension 70 of FIG. 5. In other words, the front suspension 70 includes an enlarged cradle section in comparison to that shown in FIG. 4. In such an arrangement, the front suspension 70 must include an opening 72 that is aligned with the output port 16 so that the output acoustic signal can be broadcast from the receiver 10. When the alternative front suspension is used, the receiver 10 is clamped in position between the cradle section of the front suspension 70 and the cradle 50 of the rear suspension 32. In effect, the receiver 10 is then locked into place within the surrounding structure via the suspension system.

Figure 6:
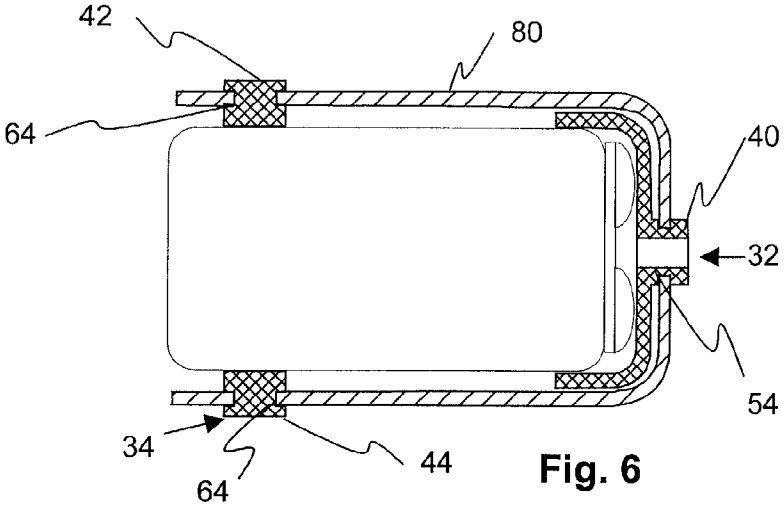
FIG. 6 illustrates a receiver incorporating the mechanical suspension system mounted within a surrounding structure.

FIG. 6 illustrates the receiver 10 having a mechanical suspension system with the back suspension 32 and the front suspension 34 mounted within a surrounding structure 80. The working components of the receiver 10 have been excluded in FIG. 6 to provide focus on the suspension system. The surrounding structure 80 fits within the attachment regions 64 in the front contact structures 42, 44, while also fitting within the attachment region 54 of the back contact structure 40. Accordingly, the mechanical suspension system provides for a three-point suspension system, instead of the series of contact points used in the prior art systems. The three-point suspension system ensures a statically determined suspension system.

Because the characteristics of the material that comprise the back suspension 32 and the front suspension 34 are known (e.g., modulus of resiliency), the geometry of the back suspension 32 and the front suspension 34 can be designed to provide optimum dampening of the vibrational amplitudes caused by the operation of the receiver 10. As mentioned above, the cross-sections of the front contact structures 42, 44 and the back contact structure 40 can be a variety of shapes, with the shapes affecting the rigidity of these structures (i.e., rigidity is a function of the section modulus). And, the dimensions of the front contact structures 42, 44 and the back contact structure 40 can be varied to also change the rigidity. It should be noted that the attachment regions 54, 64 have the smallest cross-sections and will be the portion of the front contact structures 42, 44 and the back contact structure 40 that dictates the vibration dampening qualities of these structures.

The surrounding structure 80 can be one of several structures. It can be the housing of a listening device, such as a hearing aid. It could be an internal compartment having structural walls within the housing of a listening device. Further, the surrounding structure 80 could be a secondary housing for the receiver that is used to reduce acoustic radiation, provide additional electromagnetic shielding, and/or reduce the vibration of the receiver.

Figure 7A:
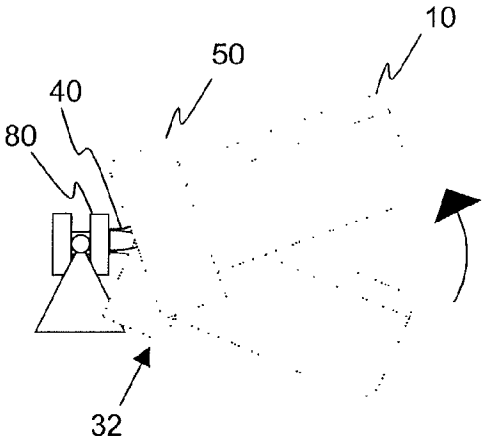
FIGS. 7A–7B schematically illustrate the movement of the receiver incorporating the mechanical suspension system.
Figure 7B:
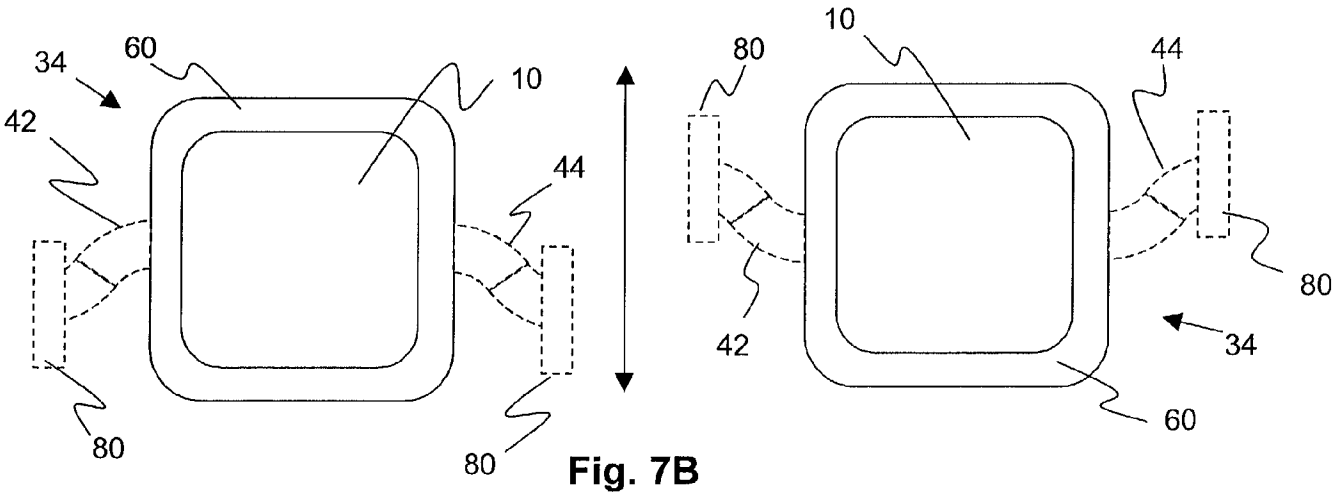

FIGS. 7A–7B schematically illustrate the effects of the front suspension 34 and the rear suspension 32. In particular, FIG. 7A illustrates the receiver 10 that is mounted within the cradle section 50 of the back suspension 32. The front contact structure 40 is attached between the cradle section 50 and the surrounding structure 80, which is held substantially in a stationary position. As can be seen, the receiver 10 tends to pivot around the portion of the surrounding structure 80 that is attached to the back contact structure 40.

FIG. 7B illustrates the vertical movement at the front end of the receiver 10 where the cradle section 60 of the front suspension 34 is attached. The front contact structures 42, 44 are coupled between the cradle section 60 of the front suspension 34 and the surrounding structure 80.

Figure 8B:
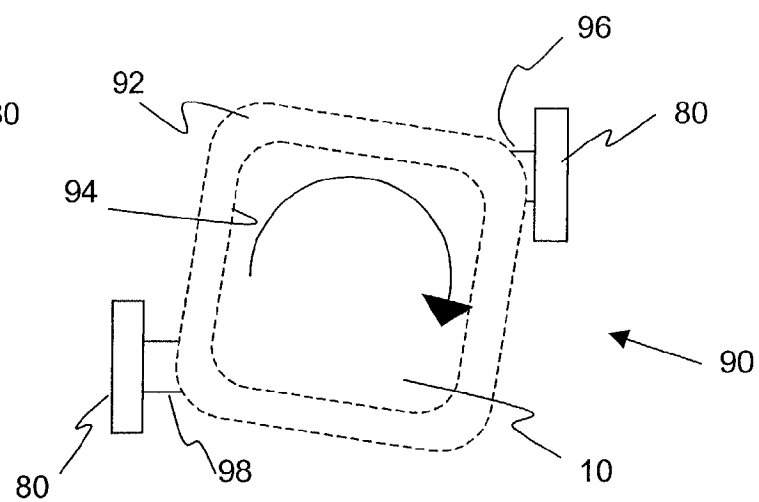
FIGS. 8A–8C illustrate an alternative mounting arrangement for the front suspension in the mechanical suspension system.
Figure 8A:
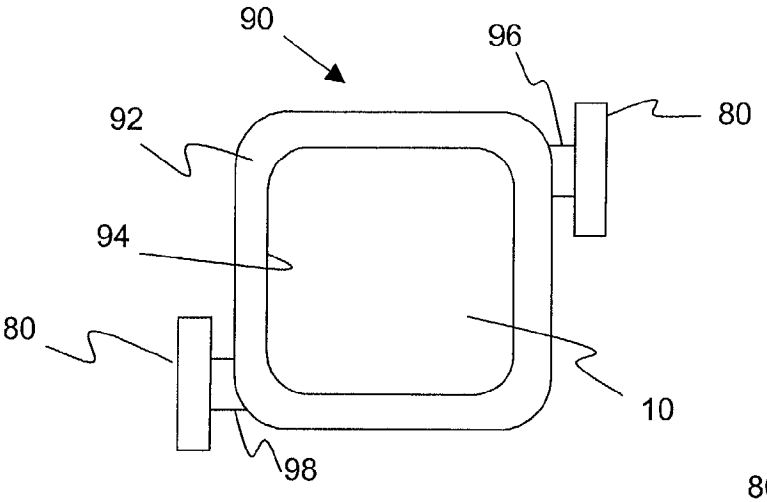

FIG. 8A illustrates an alternative front suspension 90 that includes a cradle section 92 having an interior surface 94 for engaging the receiver 10. A pair of front contact structures 96, 98 connect the cradle section 92 to the surrounding structure 80. The difference between the configuration of the alternative front suspension 90 of FIG. 8A and the front suspension 34 shown previously is that the front attachment structures 96, 98 are positioned at different heights along the side surfaces of the receiver 10. As shown in FIG. 8B, the vertical movement that is normally found in the front of the receiver 10 is translated into rotational movement that may be absorbed more efficiently by the front suspension system 90. For some receivers, it may also be beneficial to have the two front attachment structures at different lengths along the sides of the receiver 10 (i.e., the length being measured as the distance from the back side 12 of the receiver 10). In this situation, the normal vertically-oriented amplitude will be dampened into lesser vertical amplitude and also rotational movement.

Figure 8C:
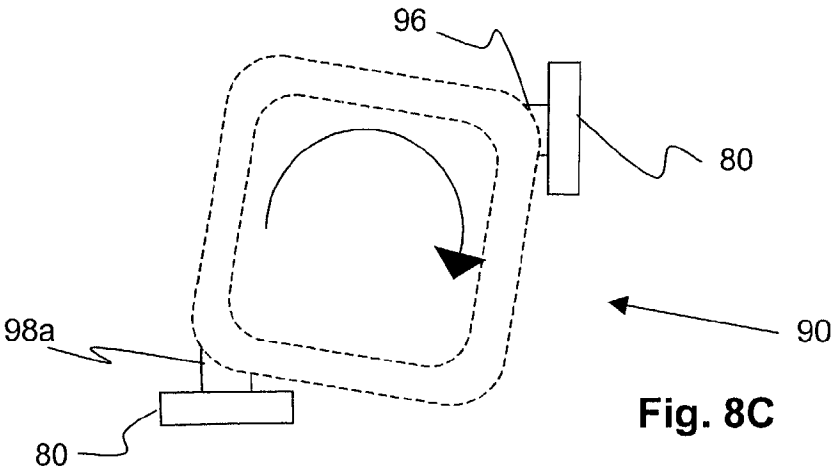

FIG. 8C illustrates a variation of the front suspension 90 where one of the front contact structures 98*a* is located on the bottom side of the receiver 10. Again, this embodiment results in the vertical movement being translated into rotational movement.

Figure 9:
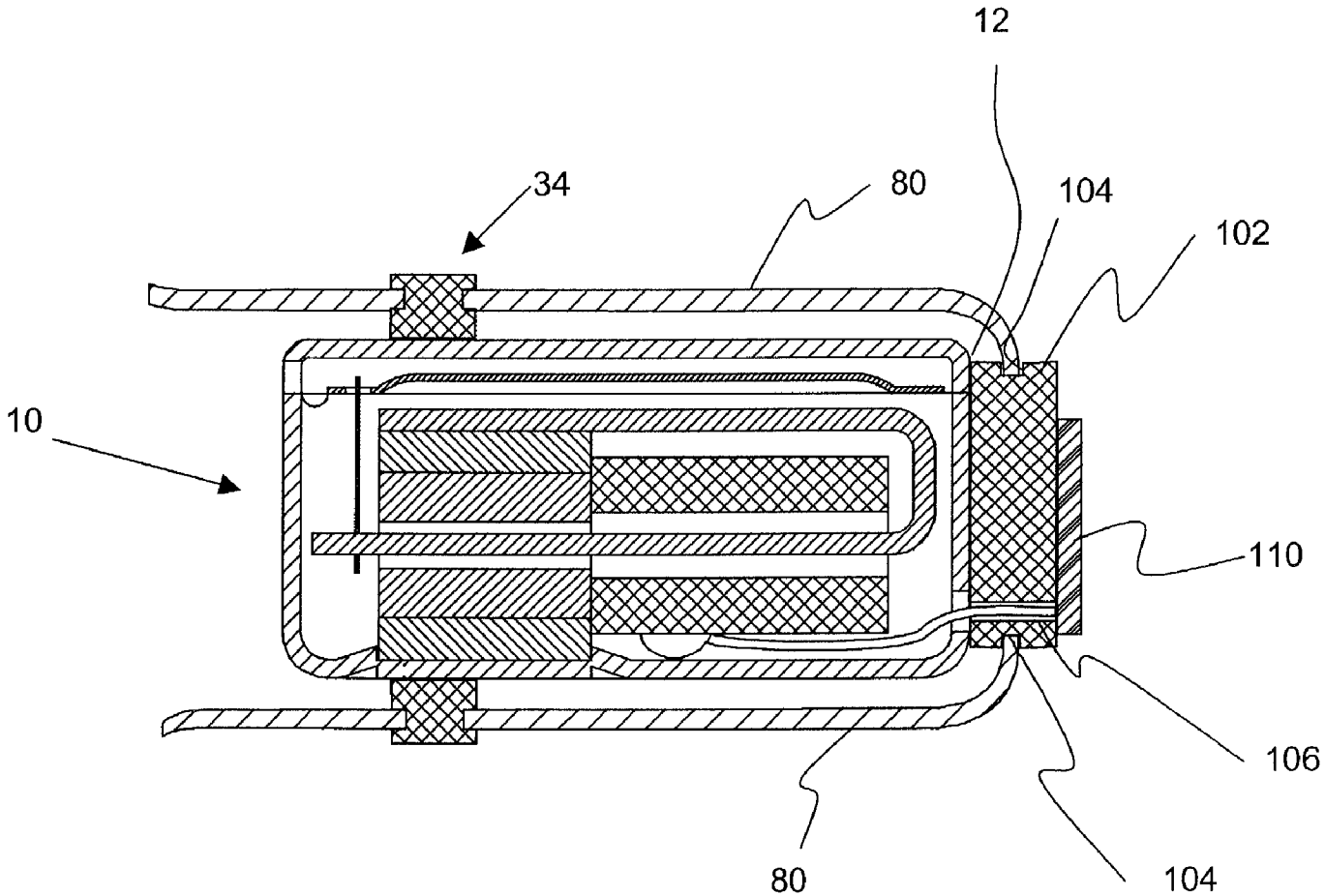
FIG. 9 illustrates an alternative embodiment to the back suspension.

FIG. 9 illustrates an alternative embodiment for the back suspension. A resilient layer 102 is placed against the back side 12 of the receiver 10. The resilient layer 102 has grooves 104 for receiving the stationary structure 80. The resilient layer 102 further includes a passage 106 for a wire leading from a printed circuit board 110 to the receiver 10. While one passage 106 is shown, the resilient layer 102 may have additional passages for electrical leads. In essence, the resilient layer 102 is sandwiched between the back side 12 of the receiver and the printed circuit board 110.

The resilient layer 102 can be made of a variety of materials, such as a silicone elastomer. The resilient layer 102 is attached to the printed circuit board 110 and the housing with an adhesive, or the entire sandwich can be held together with fasteners.

The embodiment of FIG. 9 is advantageous in that it provides a suspension and an electrical connector (i.e., the printed circuit board) in one assembly, which makes it easier to manufacture and assemble into the final assembly. It also provides an acoustic seal at the opening in the back side 12 of the receiver 10 where the wire passes.

Figure 10:
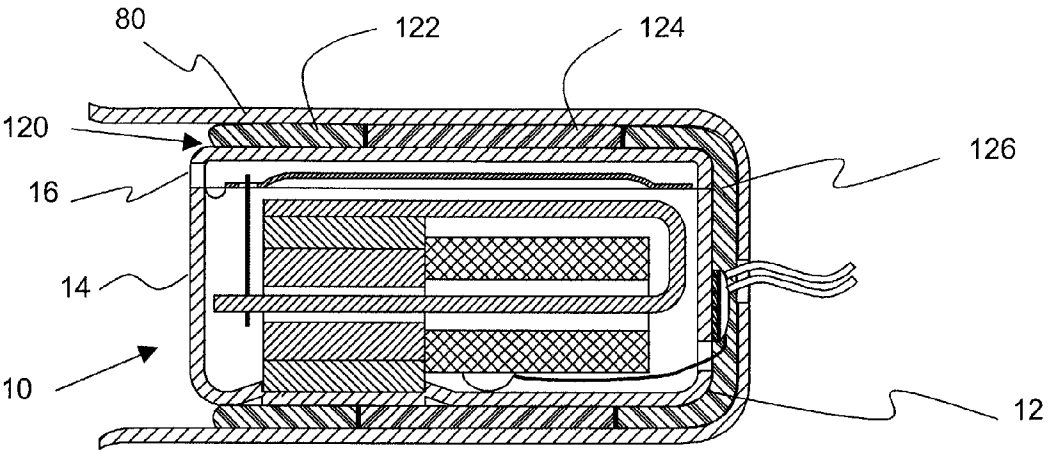
FIG. 10 illustrates yet a further alternative embodiment to the inventive mechanical suspension system that includes the use of a low viscous material.

FIG. 10 illustrates yet another embodiment of the mechanical suspension system where the receiver 10 is isolated from the surrounding structure via a viscoelastic pad 120. The pad 120 is preferably made of a low viscosity material, such as a gel-like viscoelastic material. Examples of gel-like viscoelastic materials include silicone gel, vinyl plastisols, and polyurethane elastomers.

While the pad 120 can have continuous properties, the pad 120 as shown is being made of several pieces of material having different dampening levels. A first layer 122 is located near the front side 14 and provides the most dampening. The second layer 124 is in the middle and provides slightly less dampening. The third layer 126 is located near the back side 12 of the receiver 10 and has even less dampening. While this embodiment illustrates a pad 120 filling the entire volume between the receiver 10 and the surrounding structure 80, the pad 120 can also be configured to fill only a part of this volume. It should be noted that the pad also provides substantial shock resistance and reduces undesirable acoustic radiation, as well.

Figure 11:
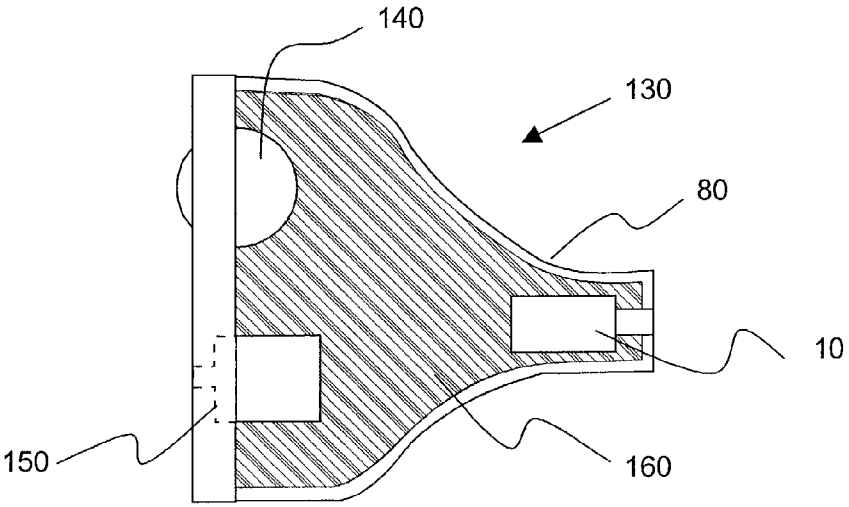
FIG. 11 illustrates a further alternative embodiment to the inventive mechanical suspension system that includes the use of a low viscous material between the receiver and the hearing aid housing.

FIG. 11 illustrates a variation of the embodiment of FIG. 10 where the surrounding structure 80 is the housing of a hearing aid 130. The hearing aid 130 includes the receiver 10, a battery 140, and a microphone 150. The components are coupled through electronic circuitry which is not shown. The housing of the hearing aid 130 is filled with a viscoelastic material 160 to minimize the feedback (vibrational and acoustical) between the receiver 10 and the microphone 150. The viscoelastic material 160 minimizes the vibration in the housing of the hearing aid 130 and the vibration of the electronic circuitry including the wires contained within the hearing aid 130.

Figure 12A:
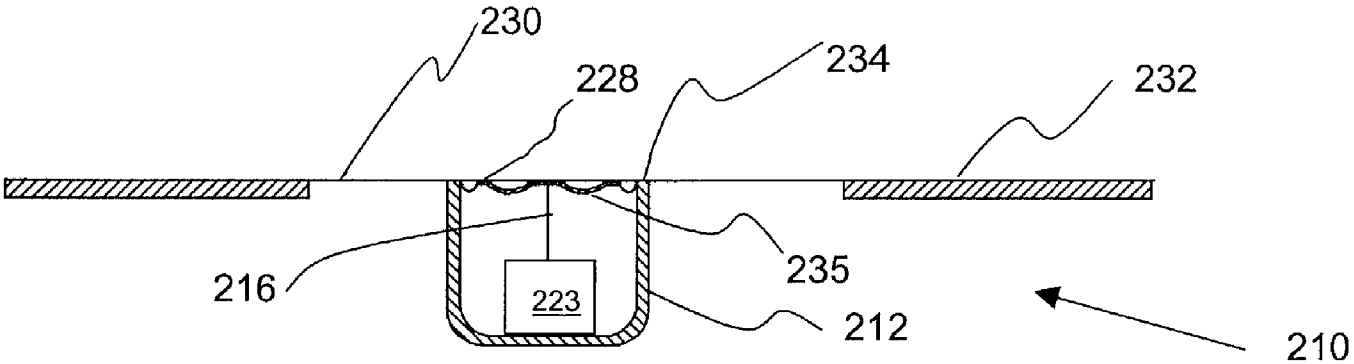
Figure 12B:
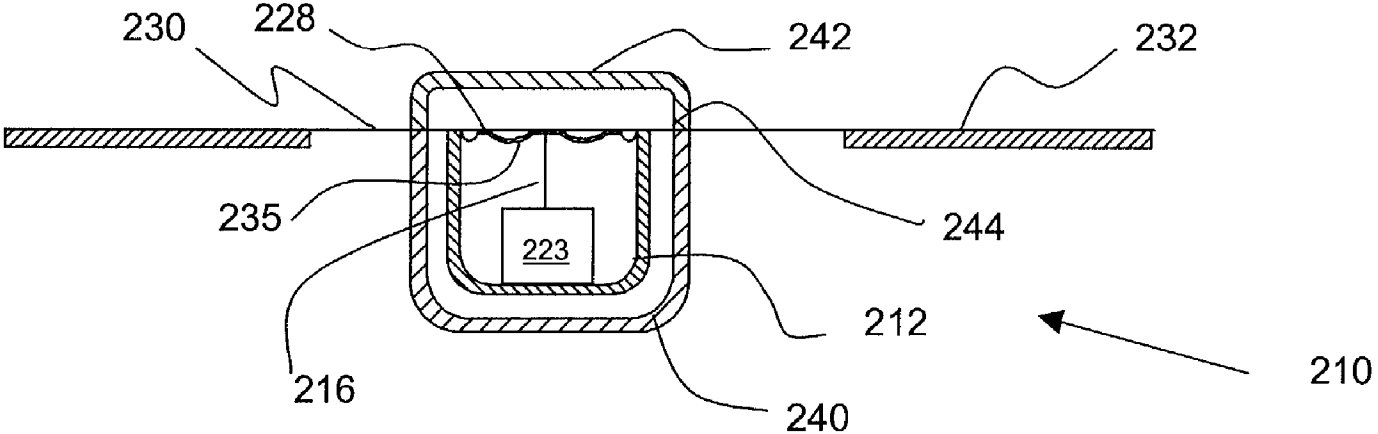
Figure 13A:
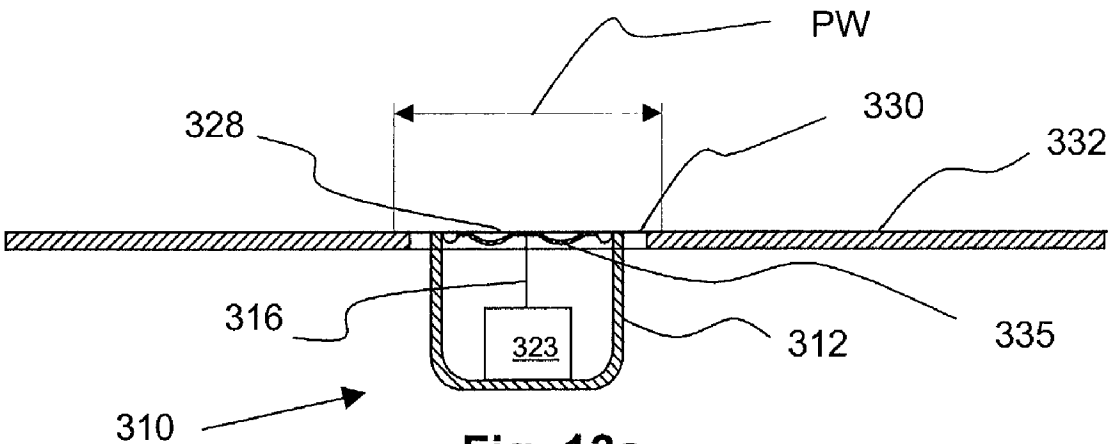
FIGS. 13A–13B illustrate an alternative of FIGS. 12A–12B where a portion of the diaphragm is accompanied by a carrier during the receiver assembly process and that carrier assists in providing mechanical suspension.
Figure 14:
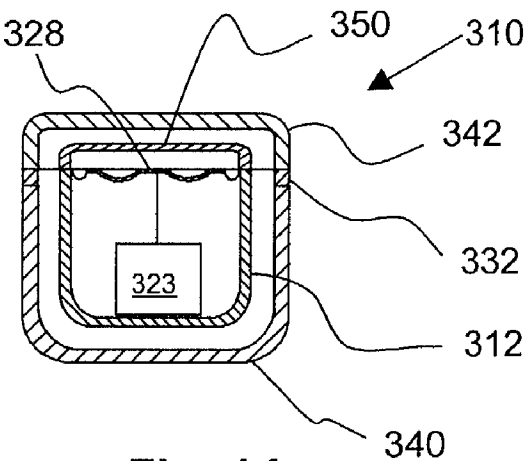
FIG. 14 illustrates one possible variation of both FIGS. 12 and 13.

FIGS. 12–14 illustrate an alternative embodiment for providing a mechanical suspension to a receiver. In FIGS. 12A and 12B, a receiver 210 is illustrated in the process of being assembled. The receiver 210 includes a housing 212 that surrounds a drive pin 216 coupling an EM drive assembly 223 to a diaphragm 228. The EM drive assembly 223 is shown in a schematic form and generally includes the combination of the coil, the magnetic stack, and the armature, as shown in the previous embodiments. The details and operation of the receiver shown in FIGS. 12–14 are discussed in U.S. Pat. No. 6,078,677, which is incorporated herein by reference in its entirety.

The assembly process includes making the diaphragm 228 by placing a membrane or foil 230 (hereinafter "foil") over the top edge of the housing 212. The foil 230 can be a variety of materials, such as polyurethane with a thickness of about 0.025 mm. The foil 230 is mounted on a carrier 232 during the assembly process and is attached at an interface 234 to the housing 212, usually by glue or adhesive. To complete the diaphragm 228, a reinforcement layer 235 may be attached to the foil 230. As shown in FIG. 12A, the reinforcement layer 235 is attached to the bottom of the foil 230 and is coupled to the drive pin 216, although the reinforcement layer 235 could also be located above the foil 230.

As shown in FIG. 12B, to provide for the mechanical suspension, an outer case 240 is attached to the foil 230 at an extending region of the foil 230 located outside the receiver housing 212. On the top side of the diaphragm 228, an outer cover 242 is also attached to the foil 230. The outer cover 242 has a sound port (not shown) for transmitting a sound produced by the diaphragm 228 as it is driven by the EM drive assembly 223. An adhesive is typically placed at an interface 244 where the foil 230 meets both the case 240 and the cover 242. The outer case 240 is separated from the housing 212 by distance that is typically less than about 0.35 mm. Wile the outer case 240 is shown as having a shape that is similar to that of the housing 212, these two structures can have a different shape, as well.

Due to this configuration, the EM drive assembly 223 and the housing 212 are suspended within the outer case 240 and the outer cover 242 by the foil 230 located outside the periphery of the housing 212. Thus, this suspension or hanging of the housing 212 minimizes the amount of vibration emanating from the receiver 210. In other words, while the housing 212 may vibrate within the outer case 240 due to the suspension system from the foil 230, the outer case 240 does not vibrate or vibrates only minimally. Furthermore, the outer case 240 and the cover 242 also provide additional electromagnetic shielding to and from the EM drive assembly 223.

As an alternative embodiment, the outer case 240 and the cover 242 can be removed in their entirety. The portion of the foil 230 extending outwardly from the case 212 is attached to an external mounting structure within the hearing aid or other listening device such that the receiver 210 is still suspended via the foil 230. In this embodiment, a housing cover would be placed over the diaphragm 228 and include an output port for the sound.

Figure 13B:
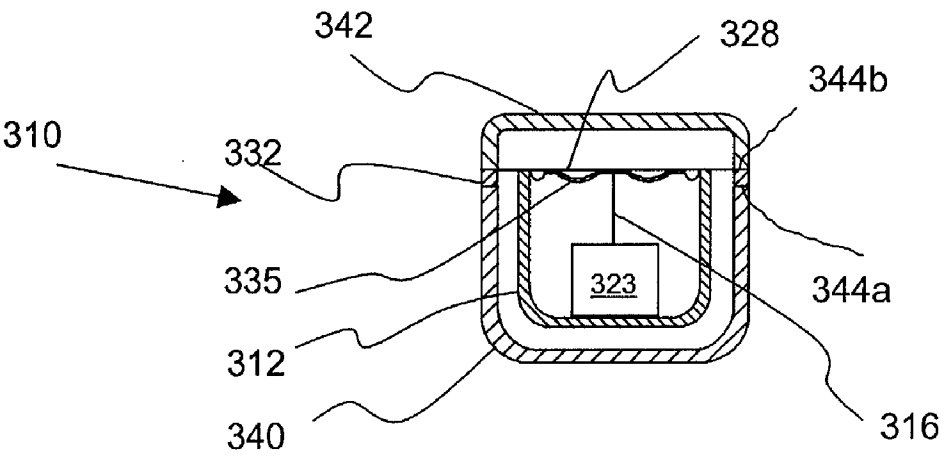

FIGS. 13A and 13B illustrate an alternative embodiment of a receiver 310 that is suspended so as to reduce mechanical vibration emanating therefrom. The receiver 310 includes a housing 312 that encloses an EM drive assembly 323. The EM drive assembly 323 is coupled to a diaphragm 328 via a drive pin 316. Again, the diaphragm 328 typically has two layers, the membrane or foil 330 and a reinforcement layer 335. In the embodiment of FIG. 13, the foil 330 is attached to its carrier 332 at a location that is closer to the case 312. The carrier 332 is then punched at a certain punch width, PW, so that part of the carrier 332 remains attached to the foil 330.

In FIG. 13B, an outer case 340 and an outer cover 342 are attached to the carrier 332 at a lower interface 344*a* and an upper interface 344*b*. The carrier 332 can be made of various material, such as a nickel-iron alloy (e.g., Perimphy SP), such that it can be laser welded at these interfaces 344. As with the previous embodiments, the outer cover 342 includes a sound port (not shown) through which sound passes as the diaphragm 328 is moved by the EM drive assembly 323. Accordingly, this embodiment differs from the embodiment of FIG. 12 in that the carrier 332 forms a frame that is sandwiched between the outer case 340 and the outer cover 342.

FIG. 14 illustrates an alternative embodiment where the receiver 310' includes a housing cover 350 that is mounted on the case 312 above the diaphragm 328. Otherwise, the mechanical suspension system is the same as that which has been shown in FIG. 13 In this situation, the housing cover 350 would have an output port in alignment with the output port of the outer cover 342. In yet a further embodiment, the outer cover 342 can be removed and the outwardly extending region of the foil 330, which is located beyond the periphery of the housing 312, is attached only to the outer case 340. In this further embodiment, the housing cover 350 would still be located over the diaphragm 328 such that the combination of the housing 312, the housing cover 350, and all of the working components within the housing 312 and the housing cover 350 are suspended by the foil 330 that is attached to the outer case 340.

Broadly speaking, the invention of FIGS. 12–14 can be characterized as a miniature receiver comprising an electromagnetic drive assembly for converting an input audio signal into movement of a drive pin. The receiver has a housing surrounding the electromagnetic drive assembly. A diaphragm of the receiver is coupled to the drive pin for producing an output acoustic signal corresponding to the input audio signal. The diaphragm is mounted around at least a portion of a periphery of the housing and includes an outwardly extending region that extends beyond the periphery of the housing. An outer structure, such as an outer case, is attached to the outwardly extending region for mechanically suspending the housing. The outwardly extending region of the diaphragm may be a foil that is used for making the diaphragm.

Alternatively, the invention of FIGS. 12–14 can be characterized as a miniature receiver including components for converting an input audio signal into an output acoustic signal. The receiver has a housing for surrounding at least a portion of the components. A thin layer of material extends outwardly from the housing for attachment to an external structure to provide for the mechanical suspension of the housing. Preferably, one of the internal components is a diaphragm and the thin layer of material providing the suspension is a portion of the diaphragm. In essence, the invention relates to a method of providing a mechanical suspension to a receiver. The method includes the steps of attaching a thin layer of material to a housing of the receiver, and attaching the thin layer of material to an external structure outside the housing. The external structural is preferably an outer casing around the housing.

While the present invention has been described with reference to one or more particular embodiments, those skilled in the art will recognize that many changes may be made thereto without departing from the spirit and scope of the present invention. For example, the inventive mechanical suspension systems have been described with respect to a receiver. These suspension systems are, however, useful for other electro-acoustic transducers, such as microphones. Each of these embodiments and obvious variations thereof is contemplated as falling within the spirit and scope of the claimed invention, which is set forth in the following claims.

What is claimed is:

1. A miniature receiver, comprising:

electro-acoustic components for converting an input audio signal to an output acoustic signal;

a housing for containing at least a portion of said electro-acoustic components, said housing including a port for broadcasting said output acoustic signal, said housing including an end surface through which an electrical connector receives said input audio signal, said end surface being generally opposite of said port; and a suspension system coupled to said housing for dampening vibrations of said housing, said suspension system including exactly three resilient contact structures configured to maintain direct contact with external structures surrounding said receiver during operation that causes said vibrations, one of said exactly three resilient contact structures being at said end surface and two of said exactly three resilient contact structures being away from said end surface.

2. The receiver of claim 1, wherein said electro-acoustic components include electromagnetic elements, all of said electro-acoustic components being contained in said housing.

3. The receiver of claim 1, wherein said housing receiver has six surfaces, two of said three resilient contact structures extending from opposing surfaces, one of said three resilient contact structures extending from a surface bridging said opposing surfaces.

4. The receiver of claim 3, wherein said opposing surfaces have heights, said two of said three resilient contact structures being at substantially the same height on respective ones of said opposing surfaces.

5. The receiver of claim 3, wherein said opposing surfaces have heights, said two of said three resilient contact structures being at different heights on respective ones of said opposing surfaces for translating vibrations into rotational movement.

6. The receiver of claim 3, wherein said opposing surfaces have lengths measured from said bridging surface, said two of said three resilient contact structures being at different lengths on respective ones of said opposing surfaces.

7. A receiver, comprising:

electro-acoustic components for converting an input audio signal to an output acoustic signal;

a housing for containing at least a portion of said electro-acoustic components, said housing including a port for broadcasting said output acoustic signal, said housing having a plurality of surfaces, adjacent ones of said plurality of surfaces meeting at a corner; and a suspension system coupled to said housing for dampening vibrations of said housing, said suspension system including three resilient contact structures having a region of reduced cross-section and configured to maintain direct contact with external structures surrounding said receiver during operation that causes said vibrations, at least one of said three resilient contact structures being positioned along said surfaces away from said corners, said three resilient structures being located away from said port so as to avoid being directly exposed to said output acoustic signal as said output acoustic signal exits said port.

8. The receiver of claim 7, wherein said plurality of surfaces comprise a housing having six surfaces, two of said three resilient contact structures extending from opposing surfaces, one of said three resilient contact structures extending from a surface bridging said opposing surfaces.

9. The receiver of claim 8, wherein said opposing surfaces have heights, said two of said three resilient contact structures being at substantially the same height on respective ones of said opposing surfaces.

10. The receiver of claim 8, wherein said opposing surfaces have heights, said two of said three resilient contact structures being at different heights on respective ones of said opposing surfaces.

11. The receiver of claim 8, wherein said opposing surfaces have lengths measured from said bridging surface, said two of said three resilient contact structures being at different lengths on respective ones of said opposing surfaces.

12. An electro-acoustic transducer, comprising:

components for transducing between audio signals and acoustic signals;

a housing for containing said components, said housing including a port for passing said acoustic signals; and a suspension system coupled to said housing and including three contact structures geometrically selected, based on inherent material properties of said three contact structures having a region of reduced cross-section and to dampen vibrations of said housing, said three contact structures being configured to maintain direct contact with external structures surrounding said housing during operation that causes said vibrations, said three contact structures being located away from said port so as to avoid being directly exposed to said acoustic signals at said port.

13. The transducer of claim 12, wherein said suspension system converts said vibration to rotational movement.

14. A transducer, comprising:

components for transducing between audio signals and acoustic signals;

a housing for containing said components, said housing including a port for passing said acoustic signals; and a suspension system coupled to said housing providing variable dampening levels along said housing, said suspension system including three resilient structures having a region of reduced cross-section and that are configured to maintain direct contact with external structures surrounding said housing during operation that causes vibrations and, three resilient structures being located away from said port so as to avoid being directly exposed to said acoustic signals at said port.

15. The transducer of claim 14, wherein said suspension system converts said vibrations to rotational movement.

* * * * *